US005479981A

United States Patent [19]

Kim

[11] Patent Number: 5,479,981

[45] Date of Patent: Jan. 2, 1996

[54] METHOD FOR CASTING A HOLLOW CAMSHAFT FOR INTERNAL COMBUSTION ENGINE

[75] Inventor: Taeyoung Kim, Kyungsangnam-do, Rep. of Korea

[73] Assignee: Hyundai Motor Company, Seoul, Rep. of Korea

[21] Appl. No.: 175,296

[22] Filed: Dec. 29, 1993

[51] Int. Cl.[6] ..... B22C 9/10; B22C 9/24; B22D 25/00

[52] U.S. Cl. ..... 164/16; 164/28; 164/30; 164/132; 164/137

[58] Field of Search ..... 164/28, 30, 132, 164/137, 340, 9, 10, 11, 16

[56] References Cited

U.S. PATENT DOCUMENTS 4,832,107 5/1989 Hass et al. .

FOREIGN PATENT DOCUMENTS

| | | | |
|---|---|---|---|
| 56-117861 | 9/1981 | Japan | 164/340 |
| 56-117864 | 9/1981 | Japan | 164/340 |
| 56-117865 | 9/1981 | Japan | 164/340 |
| 59-206141 | 11/1984 | Japan | 164/132 |
| 63-207447 | 8/1988 | Japan | 164/137 |
| 1-23225 | 5/1989 | Japan | 164/137 |

*Primary Examiner*—J. Reed Batten, Jr.
*Attorney, Agent, or Firm*—Birch, Stewart, Kolasch & Birch

[57] ABSTRACT

A core forming mold having at least three regions is provided and a molding sand is supplied into the core forming mold. The molding sand is hardened by an amine gas, to obtain a molding core having at least one region which has a diameter smaller than that of other regions. An iron casting mold is provided having a molding cavity therein, such that the molding core is positioned within the molding cavity of the iron casting mold. A molten iron is cast within the iron casting mold to entirely enclose the molding core.

8 Claims, 7 Drawing Sheets

METHOD FOR CASTING A HOLLOW CAMSHAFT FOR INTERNAL COMBUSTION ENGINE

BACKGROUND OF THE INVENTION

1. Field of the Invention

The present invention relates to a method for casting a hollow camshaft for an internal combustion engine and, more particularly, to a method for casting a camshaft having a hollow portion having a variable inner diameter.

2. Description of Related Art

In general, a camshaft formed as a hollow body defining an elongated inner cavity is produced by a casting process. To produce the camshaft, an elongated core is positioned within an iron-casting mold.

The core is supported at one or more locations along its length and spaced a predetermined distance from an inner surface mold. However, in case of using a sand core, the sand core has been found to fail entirely beyond a given length in actual practice.

Thus, a scheme to solve the problem is disclosed in U.S. Pat No. 4,832,107. This patent discloses a glass material which is used as a molding core to have an advantage that braces are not needed. However, the casting process using a glass material as a molding core has a problem that the glass material should be removed after completing the casting, thereby wasting time and effort to produce a product. The process further has a problem that the inner surface of the casting becomes rough since gas can not be exhausted during the casting process.

Accordingly, a method using a sand core has been again improved such that a cavity is formed in the sand core along its length to improve a ventilation characteristic during the casting process.

However, when the sand core having the cavity is used, a rod is inserted into the cavity of the sand core such that both ends of the rod project from both ends of the sand core, respectively. The projecting portions of the rod are utilized as a core print whereby the camshaft produced by the core can not help becoming a hollow camshaft having both ends communicating with each other.

The hollow camshaft as described above in actual practice can not be used for a variable valve timing VVT type of engine which varies open and close timings of intake and exhaust valves in accordance a with vehicle's speed because of a problem which will be described below.

That is, to vary the open and close timings of the intake and exhaust valves according to the vehicle's speed, means for varying the open and close timings should be mounted on the camshaft. In this case, when the means, for example, a pulley, is fixed on the camshaft, a front end of a set screw undesirably penetrates the hollow portion of the shaft.

Accordingly, there have been improvements in methods for mounting the means on the hollow camshaft. As one method, a hollow cam shaft having a hollow portion having a substantially reduced inner diameter for coupling the set screw for a pulley is provided.

However, providing such a camshaft is impossible with the conventional casting method.

SUMMARY OF THE INVENTION

It is an object of the present invention to provide a crankshaft of a method for casting a hollow camshaft for a combustion engine forming a hollow portion having a variable inner diameter.

A method for casting a hollow camshaft for an internal combustion engine of the present invention comprises the steps of:

providing a core forming mold having at least three regions;

supplying a molding sand into the core forming mold;

hardening the molding sand by an amine gas;

obtaining a molding core having at least one region which has a diameter smaller than that of other regions;

providing an iron casting mold having a molding cavity therein;

positioning the molding core within the molding cavity of the iron casting mold; and casting a molten iron within the iron casting mold to entirely enclose the molding core.

As another embodiment of the present invention, a method for casting a hollow camshaft for an internal combustion engine comprises the steps of:

providing a first core forming mold having a retaining groove at both side ends thereof;

providing a rod on the retaining groove; forming a first core in the first core forming mold;

providing a second core forming mold having at least three regions;

positioning the first core connected with a pipe within the second core forming mold;

forming a second core in the second core forming mold; and casting a molten iron within an iron-casting mold to entirely enclose the molding core.

In addition, the method further includes the step of preheating the first core molding before forming the first core.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENT

Figure 1:
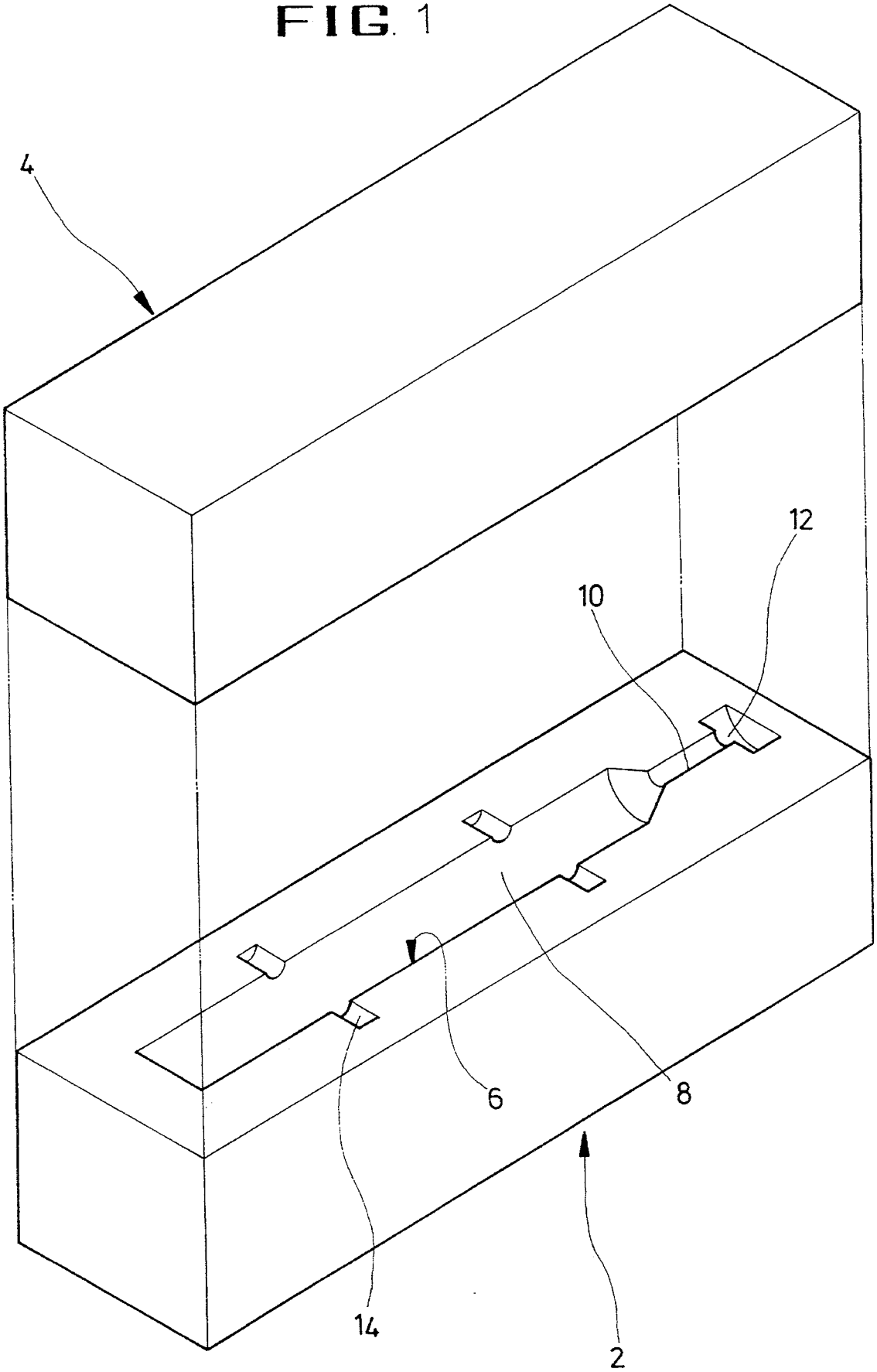
FIG. 1 is a perspective view of a core forming mold in accordance with a first embodiment of the present invention.

FIG. 1 is a perspective view of a core forming mold in accordance with a first embodiment of the present invention, in which the core forming mold comprises a lower mold half 2 and an upper mold half 4 defining therebetween a molding cavity 6. The lower and upper mold halves 2 and 4 have the same configuration as each other.

The molding cavity 6 is formed along the length of the core forming mold and includes a first region 8, a second region 10 and a third region 12.

The first region 8 has the same diameter with an inner diameter of a hollow portion of a hollow camshaft which will be produced in accordance with the present invention. The second region 10 has a diameter smaller than that of the first region 8. The third region 12 has the same diameter with that of first region 8.

At least one retaining groove 14 is provided at a circumference of the first region 8 to prevent the sand core which will be formed in the molding cavity 6 from moving in the longitudinal or circumferential directions.

Figure 2:
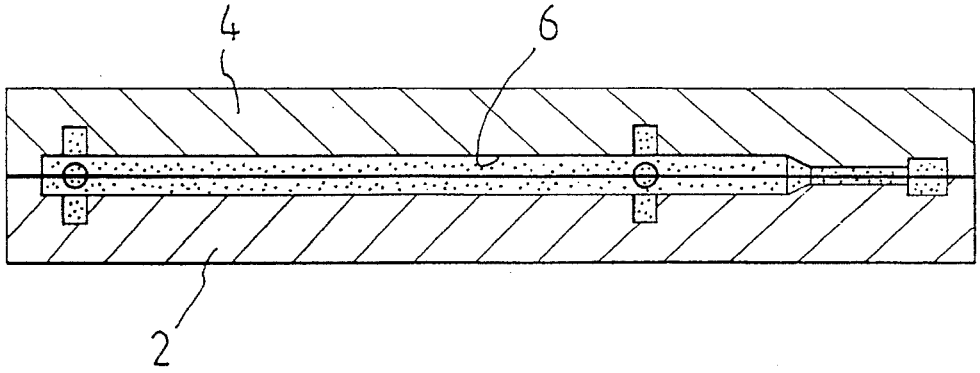
FIG. 2 is a sectional view of the core forming mold shown in FIG. 1.

FIG. 2 is a side sectional view illustrating a joining state of the lower and upper mold halves 2 and 4. In this state, a molding sand is supplied in the molding cavity 6, and then amine gas is poured in the molding cavity 6 to harden the molding sand.

Figure 3:
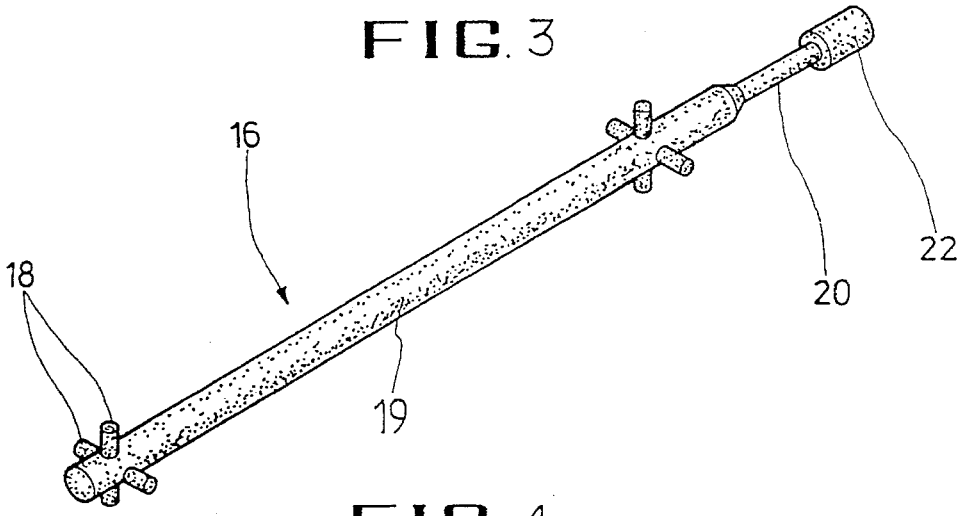
FIG. 3 is a perspective view of a sand core formed in the core forming mold shown in FIG. 2.

After completing a hardening of the molding sand, when the lower and upper mold halves 2 and 4 are separated from each other, a core 16 for casting is obtained as shown in FIG. 3. The core 16 includes a first core print 18 formed by the retaining groove 14 in the first region 8, a large diameter portion 19, a small diameter portion 20, and a second core print 22 formed by the third region 12.

Figure 4:
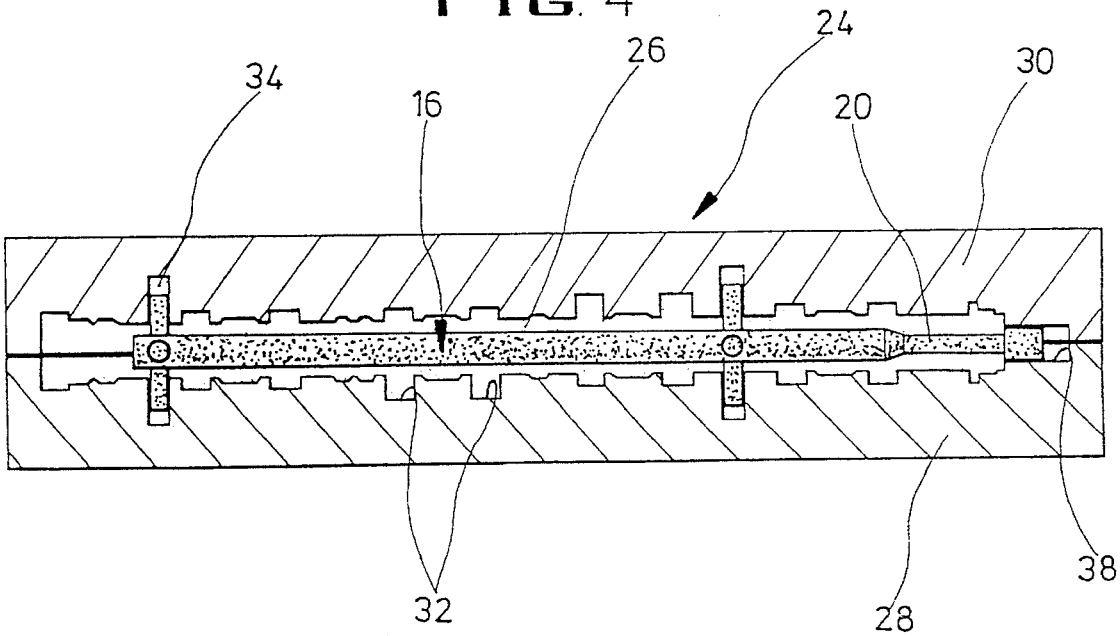
FIG. 4 is a sectional view showing an iron casting mold where the sand core shown in FIG. 3 is positioned.

FIG. 4 is a sectional view showing an iron-casting mold 24 where the core 16 shown in FIG. 3 is positioned in a casting cavity 26.

The iron casting mold 24 has a conventional structure which has lower and upper mold halves 28 and 30 defining therebetween the casting cavity 26. The casting cavity 26 has a plurality of recesses 32 for forming a lobe of the cam shaft.

Figure 5:
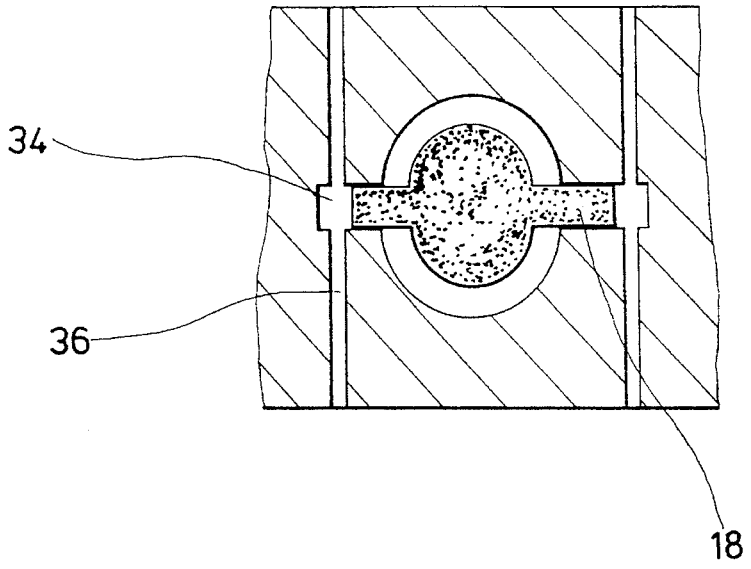
FIG. 5 is a sectional view as taken along line 5—5 of FIG. 4.

The mold further has a first groove 34 in which the first core print 18 is inserted. The first groove 34 communicates with the air via a passage 36 penetrating the iron-casting mold 24 such that a gas generated during a casting process is exhausted to the air through the passage 36 as shown in FIG. 5.

Further, a second groove 38 is formed on the casting cavity 26 to support the small diameter portion 20 of the core 16. The second groove 38 also communicates with the air as shown in FIG. 5.

As shown in FIG. 4, in a state where the core 16 is positioned in the casting cavity 26 of the iron-casting mold 24, a molten iron is poured into the casting cavity 26 to entirely enclose the core 16.

At this point, the first and second core prints of the core 16 are disposed in the first and second grooves 34 and 38, respectively, thereby preventing the core 16 from moving during the casting process.

When the molten iron is sufficiently solidified, the lower and upper mold halves 28 and 30 are separated from each other, and the casting is separated from the mold 24.

Figure 6:
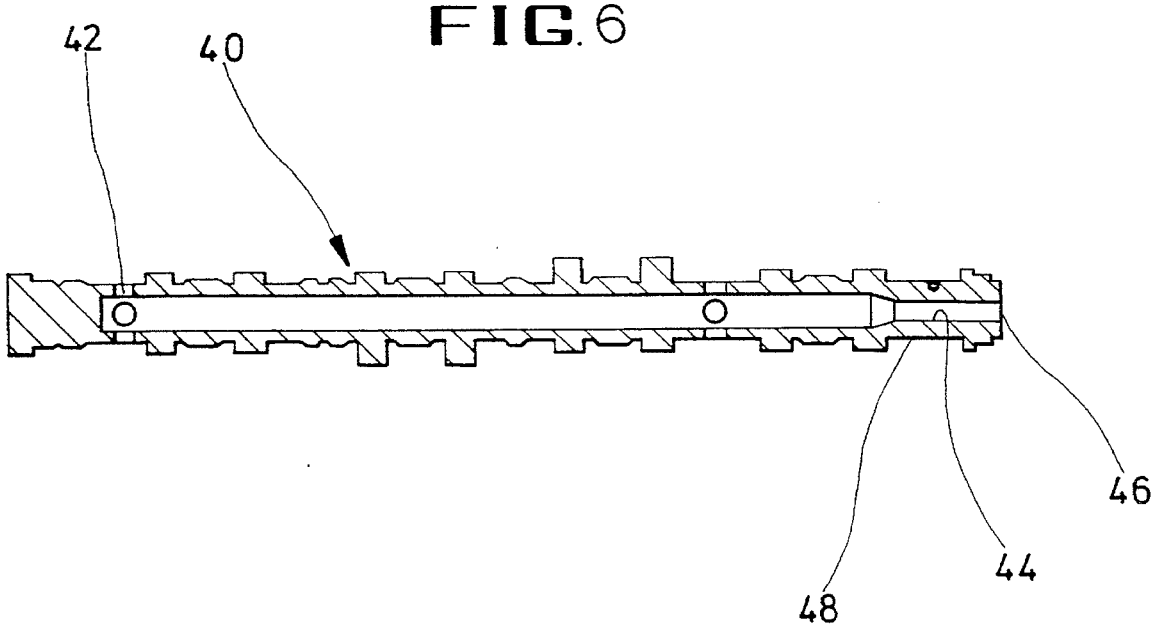
FIG. 6 is a sectional view of a hollow camshaft casted in the iron casting mold shown in FIG. 4.

At this point, the casting has the core 16 in its hollow portion. The core is eliminated by a conventional method, such that the hollow cam shaft 40 is obtained as shown in FIG. 6.

The hollow cam shaft 40 includes a hole 42 formed by the first core print 18, and a small diameter hollow portion 44 and an entrance 46 which are formed by the second core print 22.

Such a structure of the hollow cam shaft as described above has an advantage that the molding sand can be easily released.

The hollow cam shaft further includes the plurality of lobes which are formed by the plurality of recesses, and a thick region 48 compared with other regions formed by the small diameter portion 44.

The thick region 48 provides a sufficient thickness for setting the pulley used for a variable valve timing VVT type engine.

Figure 7:
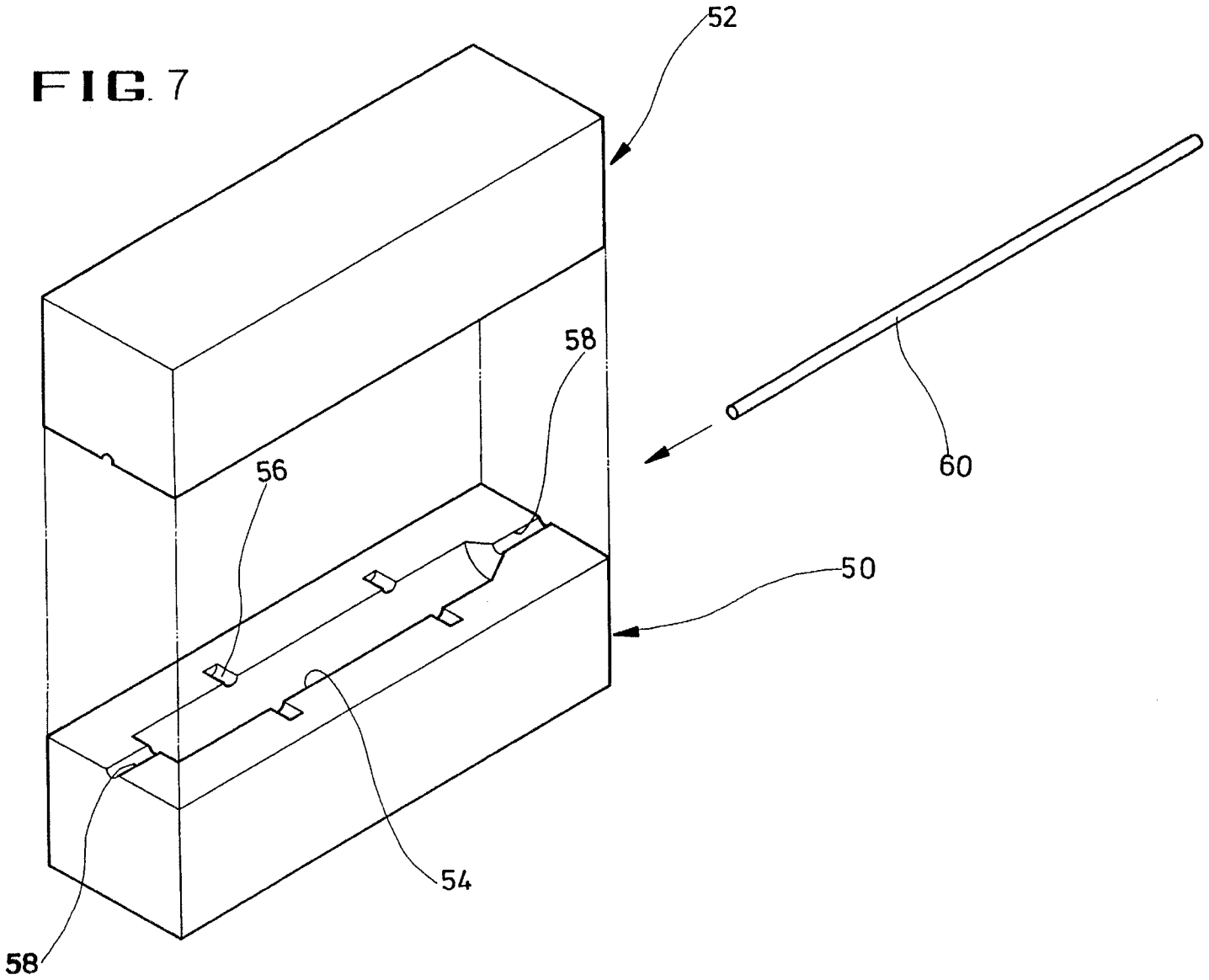
FIG. 7 is a perspective view of a first core forming mold in accordance with a second embodiment of the present invention.

FIG. 7 is a perspective view of a first core forming mold in accordance with a second embodiment of the present invention, in which the first core forming mold is composed of lower and upper mold halves 50 and 52 defining therebetween a molding cavity 54. The lower and upper mold halves 50 and 52 are of a predetermined similar configuration.

At least one retaining groove 56 is formed on a circumference of the molding cavity and a second retaining groove 58 is formed on both side ends of the molding cavity. Each depth of the first and second retaining grooves 56 and 58 is shallower than that of the molding cavity 54.

A rod 60 is positioned on the second retaining groove 58, such that the rod 60 can be located in a central line of the molding cavity 54 in a joining state of the lower and upper mold halves.

The retaining groove 56 is formed on a contacting surface of the upper and lower mold halves so that a core positioned in the molding cavity 54 can be easily separated from the molding cavity 54.

Figure 8:
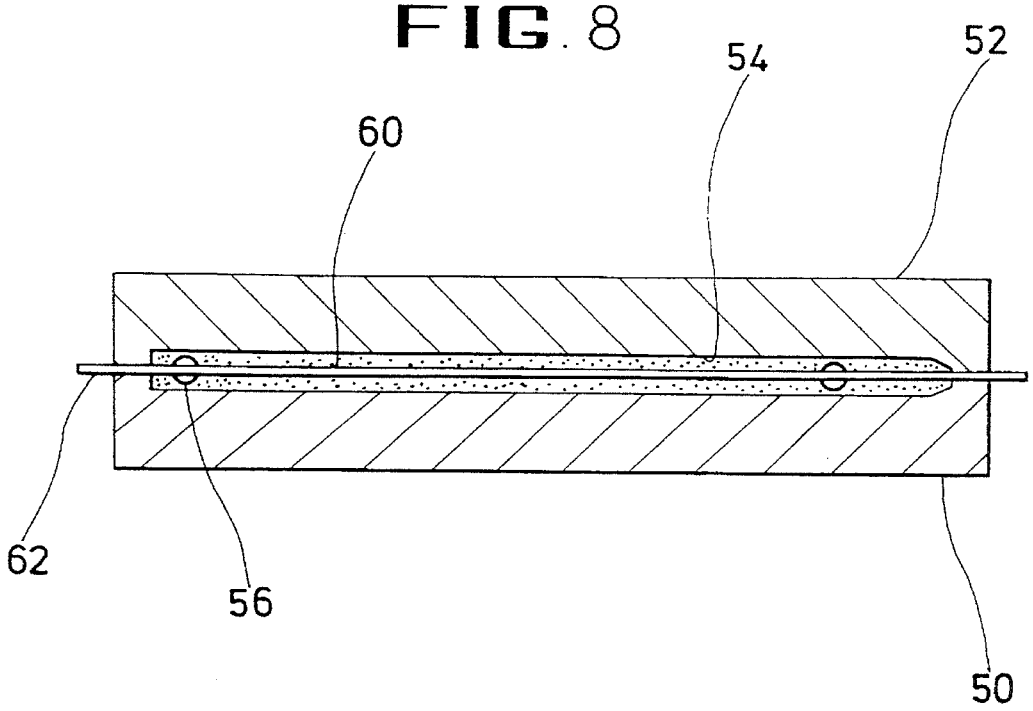
FIG. 8 is a sectional view of the first core forming mold shown in FIG. 7.

FIG. 8 is a sectional view of a first core forming mold shown in FIG. 7. In a state of joining the lower and upper mold halves, the rod 60 has an extending portion 62 extending to an outer side of the first core forming mold, such that the core can be separated from the mold without special separating means.

To obtain such a core for casting by use of the first core forming mold, a molding sand should be supplied in the molding cavity 54 after pre-heating the mold.

The reasons why the mold should be pre-heated is to harden the core during a casting process by use of a thermosetting sand as the molding sand.

Figure 9:
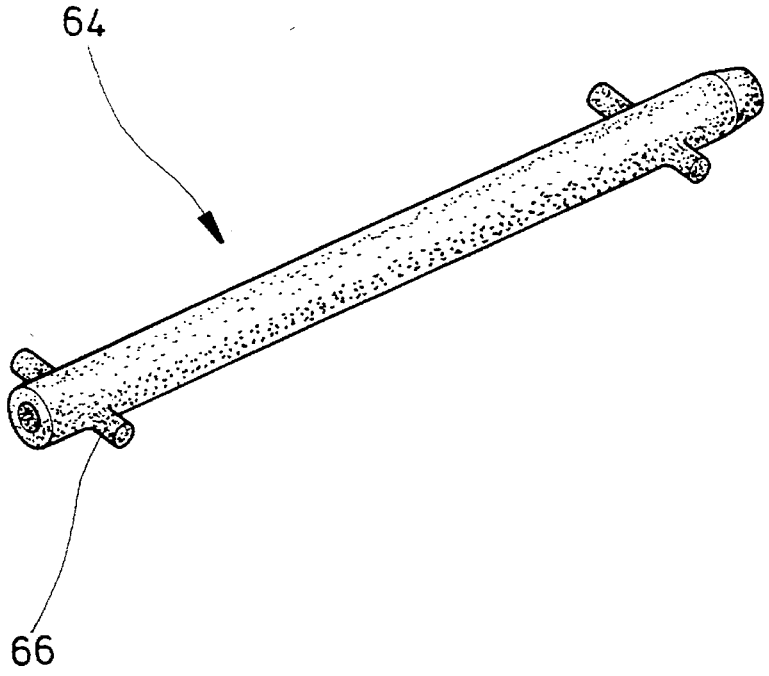
FIG. 9 is a perspective view of a sand core formed in a first core forming mold shown in FIG. 8.

After supplying the molding sand into the mold in accordance with the method as described above, when the lower and upper mold halves are separated from each other, a first core 64 for casting as shown in FIG. 9 is obtained.

The first core 64 has a core print 66 formed by the retaining groove 56, and the rod 60 is substantially inserted into the central portion of the first core. When the rod is thus taken out from the central portion of the core, the first core becomes a hollow core.

Figure 10:
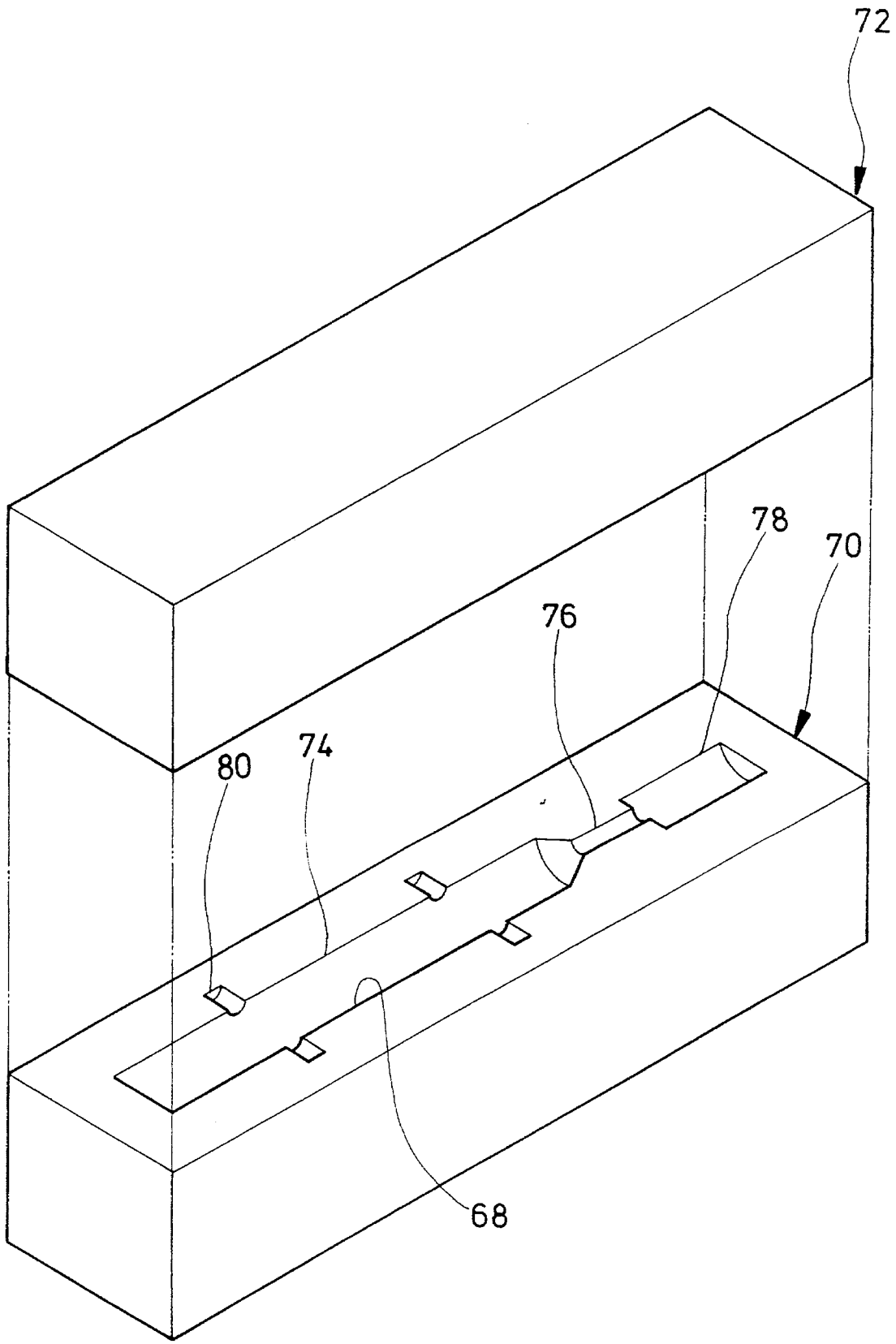
FIG. 10 is a perspective view of a second core forming mold in accordance with the second embodiment of the present invention.

FIG. 10 is a perspective view of a second core forming mold for obtaining a second core by positioning the first core 64 from the first core forming mold on the second core forming mold, in which the second core forming mold includes lower and upper mold halves 70 and 72 defining therebetween a molding cavity 68. The molding cavity 68 includes a first region 74 corresponding to the first core 64, a second region 76 having a diameter smaller than that of the first region 74, and a third region 78 having a diameter larger than that of the second region 76.

A retaining groove 80 is provided with the first region for the core print 66 of the first core 64.

Figure 11:
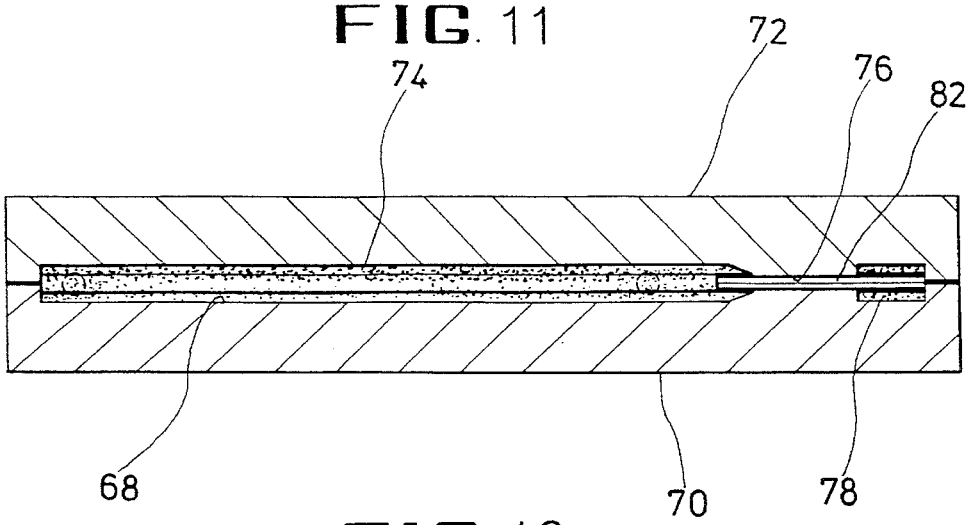
FIG. 11 is a sectional view of the second core forming mold shown in FIG. 10.

FIG. 11 is a sectional view of a second core forming mold shown in FIG. 10, wherein the first core 64 is positioned in the first region 74 of the molding cavity 68, and a metal pipe 82 is positioned on the second region 76. One end of the pipe 82 is inserted into the first core 64 and the other end of the pipe 82 extends to the third region 78.

Figure 12:
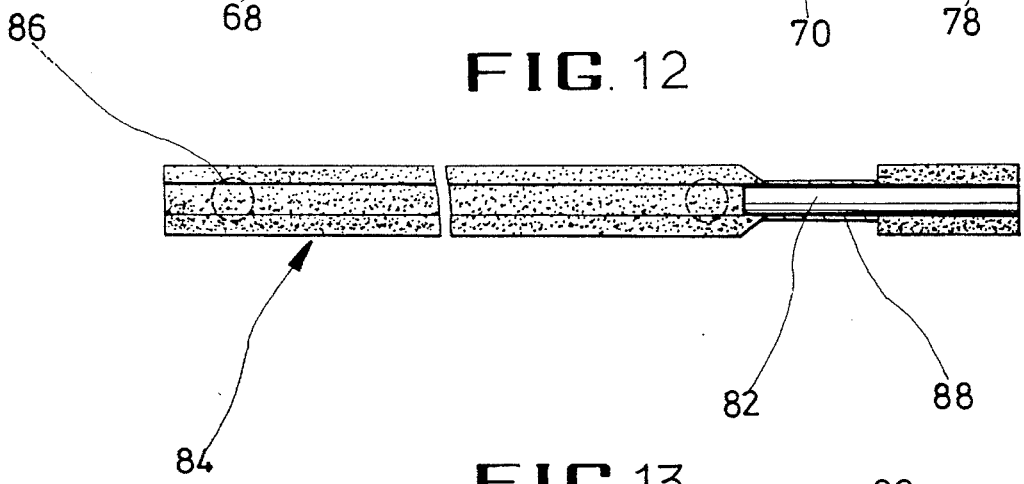
FIG. 12 is a perspective view of a sand core formed in the second core forming mold shown in FIG. 11.

At this state, a molding sand is supplied into the third region and formed by compression, thereby a second core as shown in FIG. 12 is obtained. The second core is substantially used for casting.

The second core 84 having a core print 86 is such that the molding sands are formed by compression on both ends of the pipe 82. Further, a facing material 88 is coated on a circumference of the pipe 82 so that the pipe 82 can be easily separated from the casting after completing a casting process.

The facing material is desirably a liquid material containing a silicon type material, such that the material can be easily coated by a spray on the pipe 82.

Figure 13:
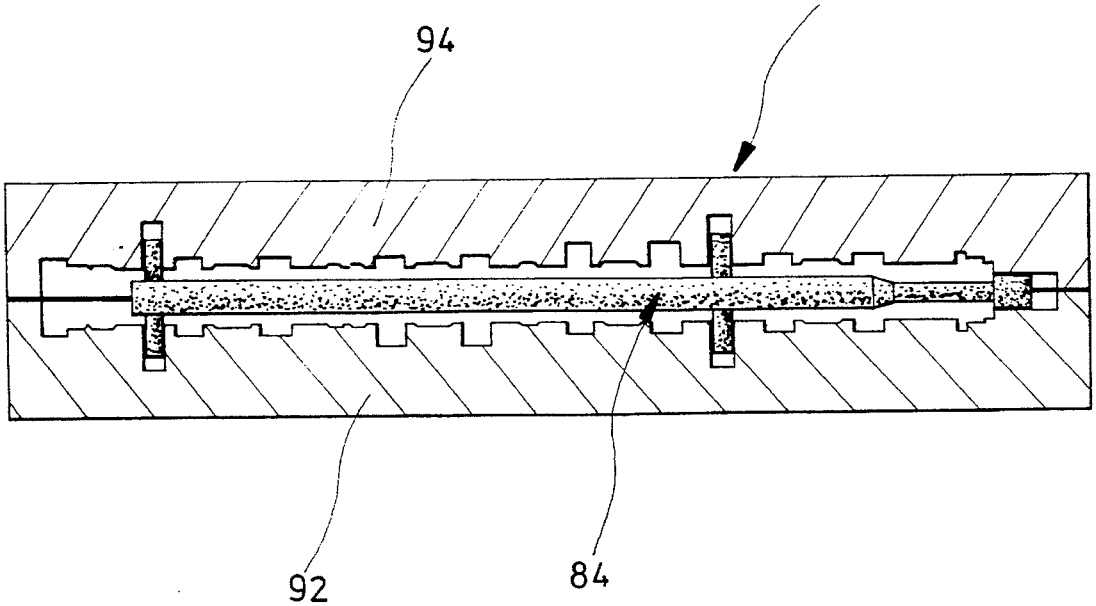
FIG. 13 is a sectional view showing an iron casting mold where the sand core shown in FIG. 12 is positioned.

FIG. 13 is a sectional view showing an iron casting mold 90 where the second core shown in FIG. 12 is positioned, in which the iron casting mold includes a lower mold half 92 and an upper mold half 94.

The iron casting mold has substantially the same structure with that of FIG. 4 which is described in the first embodiment of the present invention.

Accordingly, the casting method is the same as that of the first embodiment, whereby a structure of a hollow camshaft is the same as that of FIG. 6.

The hollow camshaft according to the first and second embodiment of the present invention has advantages that the pulley for the variable valve timing VVT type engine can be mounted on the camshaft, the gas generated during the casting process can be easily exhausted thereby obtaining the camshaft having a clean circumference, and the casting core is formed by the molding sand thereby eliminating the problems which occur when the glass material rod or carbon rod is used.

What is claimed is:

1. A method for casting a hollow camshaft for an internal combustion engine comprising the steps of:

providing a core forming mold having first, second and third molding cavities, the second molding cavity located between the first and third cavities and having a diameter less than the first and third cavities;

supplying a molding sand into the cavities of the core forming mold;

hardening the molding sand by an amine gas to obtain a molding core having a first region corresponding to the first cavity, a second region corresponding to the second cavity and a third region corresponding to the third cavity;

providing an iron casting mold having a first cavity of a configuration of the camshaft and a second cavity corresponding to the third region of the molding core;

positioning the molding core within the iron casting mold such that the first and second regions of the molding core are located within the first cavity of the iron casting mold and the third region of the molding core is fitted into the second cavity of the iron casting mold to support the molding core;

casting a molten iron within the iron casting mold to entirely enclose the first and second regions of the molding core so as to form a cast product; and separating the cast product from the iron casting mold after the molten iron has solidified and removing the molding core from the cast product, thereby obtaining the hollow camshaft having a relatively large inner diameter portion formed by the first region of the molding core and a relatively small inner diameter portion formed by the second region of the molding core.

2. The method according to claim 1, wherein the molding core includes at least two sand core prints integrally formed around the molding core.

3. The method according to claim 2, wherein the iron casting mold has a plurality of grooves formed thereon where the sand core prints are inserted.

4. The method according to claim 3, wherein the grooves communicate with air through passages formed in the iron casting mold.

5. A method for casting a hollow camshaft for an internal combustion engine comprising the steps of:

providing a first core forming mold having a retaining groove at opposing ends thereof;

providing a rod within the retaining groove;

forming a first core in the first core forming mold to surround the rod;

separating the first core from the first core forming mold and removing the rod from the first core to thereby form a penetrating hole;

providing a second core forming mold having first, second and third molding cavities, the second molding cavity located between the first and third molding cavities and having a diameter less than the first and third cavities;

inserting one end of a pipe into the penetrating hole of the first core and positioning the first core connected with the pipe within the second core forming mold such that the first core is positioned in the first cavity, the pipe is positioned in the second cavity, and the other end of the pipe extends into the third cavity;

supplying a molding sand into the third molding cavity of the second core forming mold;

hardening the molding sand to form a second core comprising the first core connected with the pipe and the other end of the pipe covered with the molding sand;

providing an iron casting mold having a first cavity of a configuration of the camshaft and a second cavity corresponding to the other end of the pipe covered with the molding core;

positioning the second core within the iron casting mold such that the first core connected with the pipe is located within the first cavity of the iron casting mold and the other end of the pipe covered with the molding sand is fitted into the second cavity of the iron casting mold to support the first core connected with the pipe;

casting a molten iron within the iron-casting mold to entirely enclose the first core connected with the pipe so as top form a cast product; and separating the cast product from the iron casting mold after the molten iron has solidified and removing the first core and the pipe from the cast product, thereby obtaining the hollow camshaft.

6. The method according to claim 5, further comprising a step of coating a facing material around the pipe before casting a molten iron.

7. The method according to claim 5, wherein the first core is formed with a thermosetting sand.

8. The method according to claim 5, further comprising a step of pre-heating the first core forming mold before forming the first core.

* * * * *